United States Patent [19]

Pilch

[11] 4,138,928

[45] Feb. 13, 1979

[54] FLUID ACTUATED APPARATUS

[75] Inventor: John S. Pilch, Ware, Mass.

[73] Assignee: Ware Machine Service Inc., Ware, Mass.

[21] Appl. No.: 767,942

[22] Filed: Feb. 11, 1977

[51] Int. Cl.[2] ..... F01B 1/04; F15B 13/06; F15B 15/22

[52] U.S. Cl. ..... 91/27; 91/31; 91/186; 91/189 R; 91/395; 91/421

[58] Field of Search ..... 91/189, 395, 421, 394, 91/27, 31, 186, 403

[56] References Cited

U.S. PATENT DOCUMENTS

| | | | |
|---|---|---|---|
| 1,283,179 | 10/1918 | Hennebohle | 91/403 |
| 1,902,018 | 3/1933 | Davis | 91/395 X |
| 2,169,470 | 8/1939 | Miller et al. | 91/443 X |
| 2,735,404 | 2/1956 | Komph, Sr. | 91/403 |
| 3,120,157 | 2/1964 | Mello | 91/443 X |
| 3,407,946 | 10/1968 | Pilch | 214/138 |
| 3,835,751 | 9/1974 | Cowan | 91/443 X |

FOREIGN PATENT DOCUMENTS

| | | | |
|---|---|---|---|
| 7412949 | 10/1974 | Netherlands | 91/39 X |
| 1372809 | 11/1974 | United Kingdom | 91/421 |

*Primary Examiner*—Irwin C. Cohen
*Attorney, Agent, or Firm*—Robert L. Thompson

[57] ABSTRACT

This invention is directed to fluid actuated apparatus for automatically restricting the flow of fluid in conduits leading to and/or from fluid actuated cylinder means for causing pivotal movement of a member, such as the turret carrying the boom and bucket of a backhoe, so that the speed of pivotal movement of the member is rapid during one portion of its pivotal movement but is automatically reduced during a predetermined portion of its subsequent pivotal movement, thereby minimizing failures of the components of the member and the fluid system and improving the braking action for reducing the speed of pivotal movement of the member. In one embodiment, both the flow of fluid to the operative fluid actuated cylinder and the flow of fluid from the inoperative fluid actuated cylinder are restricted substantially simultaneously by fluid restricting means so that the linear velocities of the rods of both cylinders are reduced substantially simultaneously by the fluid restricting means. The apparatus also includes a restricting valve means which includes fluid restricting piston means. The fluid restricting piston means is free from springs, cams and cam rollers and is economical to manufacture and to maintain.

4 Claims, 4 Drawing Figures

FLUID ACTUATED APPARATUS

BACKGROUND OF THE INVENTION

This invention relates to means for automatically restricting the flow of fluid in conduits leading to and/or from fluid actuated cylinder means for causing pivotal movement of a member whereby the speed of pivotal movement of the member is rapid during one portion of its pivotal movement but is automatically reduced during a predetermined portion of its subsequent pivotal movement, thereby minimizing failures of the components of the member which is being moved and of the fluid system and improving the braking action for reducing the speed of pivotal movement of the member.

Many devices have members which are pivotally moved by fluid actuated cylinder means, for example the pivotal movement of the turret carrying the boom and bucket of a backhoe, trencher or other excavating device. A need has long been recognized to provide means for automatically slowing down or braking the pivotal movement of such a member near the end of its pivotal movement in order to prevent damage to the apparatus when at the end of its pivotal movement the movement is completely stopped.

In my prior U.S. Pat. No. 3,407,946, dated Oct. 29, 1968, I disclosed a pair of fluid operated cylinder means and a pair of throttling valves. Each throttling valve was operable by a spring and a cam on the turret of a backhoe and followers to restrict the flow of fluid in the conduit which led from the end of one fluid cylinder means to the main control valve during the return or inactive stroke of the piston. Because the rod of one fluid cylinder was attached to the turret, a braking effect on the pivotal movement of the turret resulted and that braking effect opposed the pivoting force which was simultaneously being exerted on the turret by the piston of the other fluid actuated cylinder means. However, because during the braking action when the operator continued to hold the main control valve in a position to supply fluid under full volume to the operative end of the fluid actuated cylinder which was exerting the pivoting force and also because the momentum of the loaded bucket and swinging boom was great, it was found in practice that these combined forces during the braking portion of the pivotal movement were of such magnitude that premature and excessive failures of various components of the backhoes resulted.

In my prior U.S. Pat. No. 3,530,766 dated Sept. 29, 1970, I disclosed an improvement upon my above mentioned prior patent. This patent also used a pair of fluid operated cylinder means and a pair of throttling valves. Each throttling valve was operable by a spring and a cam on the turret of the backhoe and followers to restrict the flow of the fluid in the conduit which led from the source of fluid under pressure to the operative end of the cylinder which was exerting the pivoting force on the turret. However, it has been found in practice that the correct timing of the cams and followers of the apparatus of this patent is very difficult to achieve, that inertia or momentum of the boom during the braking action continues to counteract the effectiveness of the braking action and that the cost of manufacturing and assembling the cams, followers, throttling valves and associated parts is very expensive.

Consequently the apparatus of my two above identified U.S. patents have not solved the above mentioned long-felt need and it has not been solved by any other prior apparatus of which I am aware

BRIEF SUMMARY OF THE INVENTION

One object of this invention is to provide fluid actuated apparatus for automatically restricting the flow of fluid in conduits leading to and/or from fluid actuated cylinder means for causing pivotal movement of a member whereby the speed of pivotal movement of the member is rapid during one portion of its pivotal movement but is automatically reduced during a predetermined portion of its subsequent pivotal movement.

Another object is to provide a fluid actuated apparatus wherein the fluid restricting piston means is moved solely by pressurized fluid from its restricting position to its open end or nonrestricting position.

Another object is to provide a fluid actuated apparatus wherein the linear velocity of two individual piston rods is reduced simultaneously.

Another object is to provide a fluid actuated apparatus wherein the fluid restricting piston means may be moved to partially open position.

Another object is to provide an apparatus wherein pressurized fluid from a main control valve passing thru a conduit communicates solely with one end of a fluid restricting piston means.

Another object is to provide such an apparatus which is economical to manufacture.

A further object is to provide such an apparatus in which both the flow of fluid to the operative fluid actuated cylinder and the flow of fluid from the inoperative fluid actuated cylinder are restricted substantially simultaneously so that the linear velocities of the rod means of both cylinders are reduced substantially simultaneously by the fluid restricting means, thereby increasing effectiveness of the braking action upon the pivotal movement of the member which is being moved.

Further objects and advantages of the invention will be apparent to persons skilled in the art from the following description taken in conjunction with the accompanying drawings.

In general an apparatus embodying this invention includes a member mounted for pivotal movement, a source of fluid under pressure, a first fluid actuated cylinder means having its rod means connected to the member, the rod means being movable to rotate the member in one direction, a second fluid actuated cylinder means having its rod means connected to the member and movable when the member is rotated in one direction by the rod means of the first fluid actuated cylinder, a main control valve for selectively controlling the flow of fluid under pressure from the source of fluid to the first and second fluid actuated cylinders, a first restricting valve means comprising a first fluid restricting piston means, first fluid conduit means for providing communication directly between the main control valve and one end of the first restricting piston for causing movement of the fluid restricting piston to at least partially open and/or nonrestricting position, second fluid conduit means for providing communication between the first fluid restricting valve and the first cylinder, and third fluid conduit means for providing communication directly between the piston end of the second cylinder and the other end of the first fluid restricting piston for causing movement of the fluid restricting piston to closed position during which the flow of fluid from the source of fluid under pressure en route from the first conduit to the piston end of the first cylinder is restricted when the piston of the second cylinder approaches the end of its retracting movement, thereby reducing the linear velocity of the rod of the first cylinder as the piston of the second cylinder means approaches the end of its retracting movement.

Another embodiment comprises conduit means for providing communication between a main control valve and solely one end of a fluid restricting piston means.

Yet another preferred embodiment also includes plunger means associated with the piston of the second cylinder means, a first port in the piston end of the second cylinder which is closeable by the plunger as the piston of the second cylinder approaches the end of its retracting movement, and a second port in the piston end of the second cylinder whereby during any further retracting movement of the piston of the second cylinder fluid from the piston end of the second cylinder passed thru the reduced size second port when the first port is closed by the plunger, thereby reducing the linear velocity of the rod of the second cylinder.

In a still further embodiment, the apparatus includes a third port in the piston end of the second cylinder, this third port being constantly open and communicating with the third conduit means, whereby fluid may pass unrestricted through the third conduit means in either direction to and from the first chamber at all times.

In another embodiment, the apparatus includes a first fluid restricting piston and throughout the complete and/or power movement of the piston of the first fluid actuated cylinder, the first fluid restricting piston is simultaneously responsive to and movable by pressurized fluid from two individual sources, namely one end of said piston is responsive to and movable by pressurized fluid passing from the main control valve through the first conduit means directly to one end of the first fluid restricting piston, and the other end of said fluid piston is responsive to and movable by pressurized fluid passing from the piston end of the second fluid actuated cylinder through the third conduit means directly to said other end of the first fluid restricting piston.

In still another embodiment, the apparatus includes a second restricting valve means which includes a second fluid restricting piston means, and a fourth fluid conduit means for providing communication between the first cylinder and the other end of the second fluid restricting piston, whereby fluid under pressure passing through the fourth conduit means from the first cylinder means to the other end of the second fluid restricting piston causes one end of the second piston means to be seated.

In a yet further embodiment the second restricting valve includes check valve means and the apparatus also includes fifth fluid conduit means for providing communication between the first and second ports in the piston end of the second cylinder means and one end of the check valve, and sixth fluid conduit means for providing communication between one end of said check valve means and the main control valve, whereby fluid from the fifth conduit opens the check valve means and flows through the sixth conduit to the main control valve.

In still another embodiment the first fluid restricting valve comprises a first port which affords communication between the first conduit and one end of the first fluid restricting piston, whereby fluid under pressure from the source of fluid under pressure passing through the first port of the first fluid restricting valve moves the first fluid restricting piston to at least partially open position, thus permitting fluid under pressure from the first source of fluid under pressure to pass said one end of the first fluid restricting piston substantially unrestricted en route to the first cylinder.

In yet another embodiment, the first fluid restricting valve means is communicated with by three fluid conduits, namely the first, the second and the third fluid conduits.

In yet another embodiment, when pressurized fluid from the first source of fluid under pressure moves the first fluid restricting piston to open position at least part of the fluid in the first chamber is caused to flow into the third conduit towards the interior of the second cylinder.

In still a further embodiment, the first fluid restricting piston includes a restricting orifice whereby when the fluid restricting piston is moved to closed position the flow of pressurized fluid from the first source of fluid under pressure passes through the restricting orifice en route to the first fluid actuated cylinder means thereby reducing the linear velocity of its rod means.

In yet a further embodiment, the first fluid restricting piston means is free from coaction with spring means, cam means, follower means and the like during its movements.

In yet another embodiment, the apparatus includes a second fluid actuated cylinder means which includes piston means, plunger means associated with one end of the piston means, a first port in the second cylinder which is closable by the plunger means, a first fluid restricting piston means, a third port in the cylinder and third fluid conduit means for providing communication directly between said third port and the other end of said first restricting piston means, whereby when the first port is closed, the linear velocity of the piston rod of the second cylinder means is reduced and pressurized fluid passing through the third conduit means instantly causes movement of the first fluid restricting piston means to closed position, thereby reducing the linear velocity of the piston rod of the first cylinder means and the linear velocities of both cylinder rods are reduced substantially simultaneously.

It will be apparent to persons skilled in the art that this invention has solved the above described long-felt need and satisfied the above described objects.

DESCRIPTION OF THE PREFFERED EMBODIMENT

Figure 1:
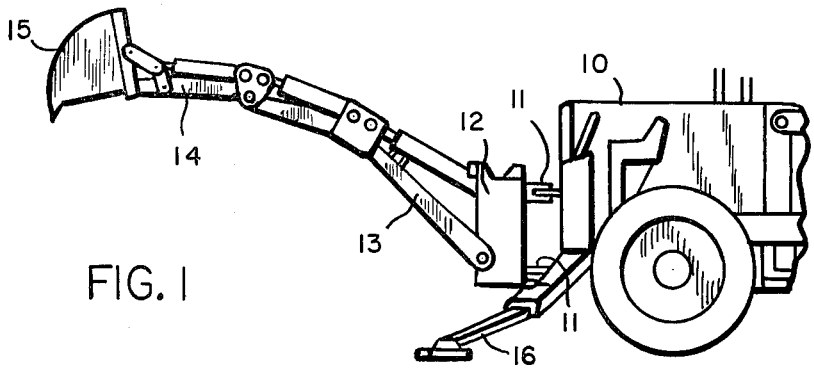
FIG. 1 is a side view of a tractor mounted backhoe having a turret to which apparatus embodying the invention may be connected to rotate the turret and boom in either direction.
Figure 2:
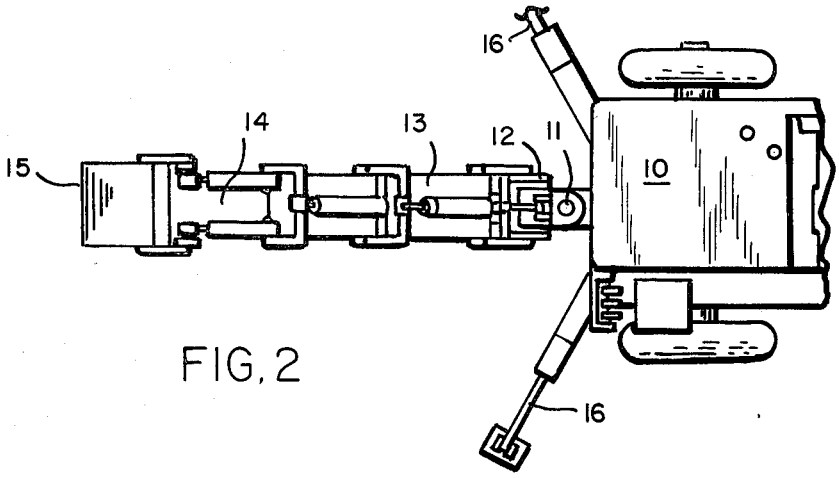
FIG. 2 is a plan view of the apparatus shown in FIG. 1.

The tractor mounted backhoe shown in FIGS. 1 and 2 comprises a tractor 10 having vertical pivots 11 and the turret 12. The turrent carries the boom 13 on the end of which is pivotally connected the dipperstick 14 which in turn carries the bucket 15.

The tractor is provided with ground engaging stabilizer legs 16.

Figure 3:
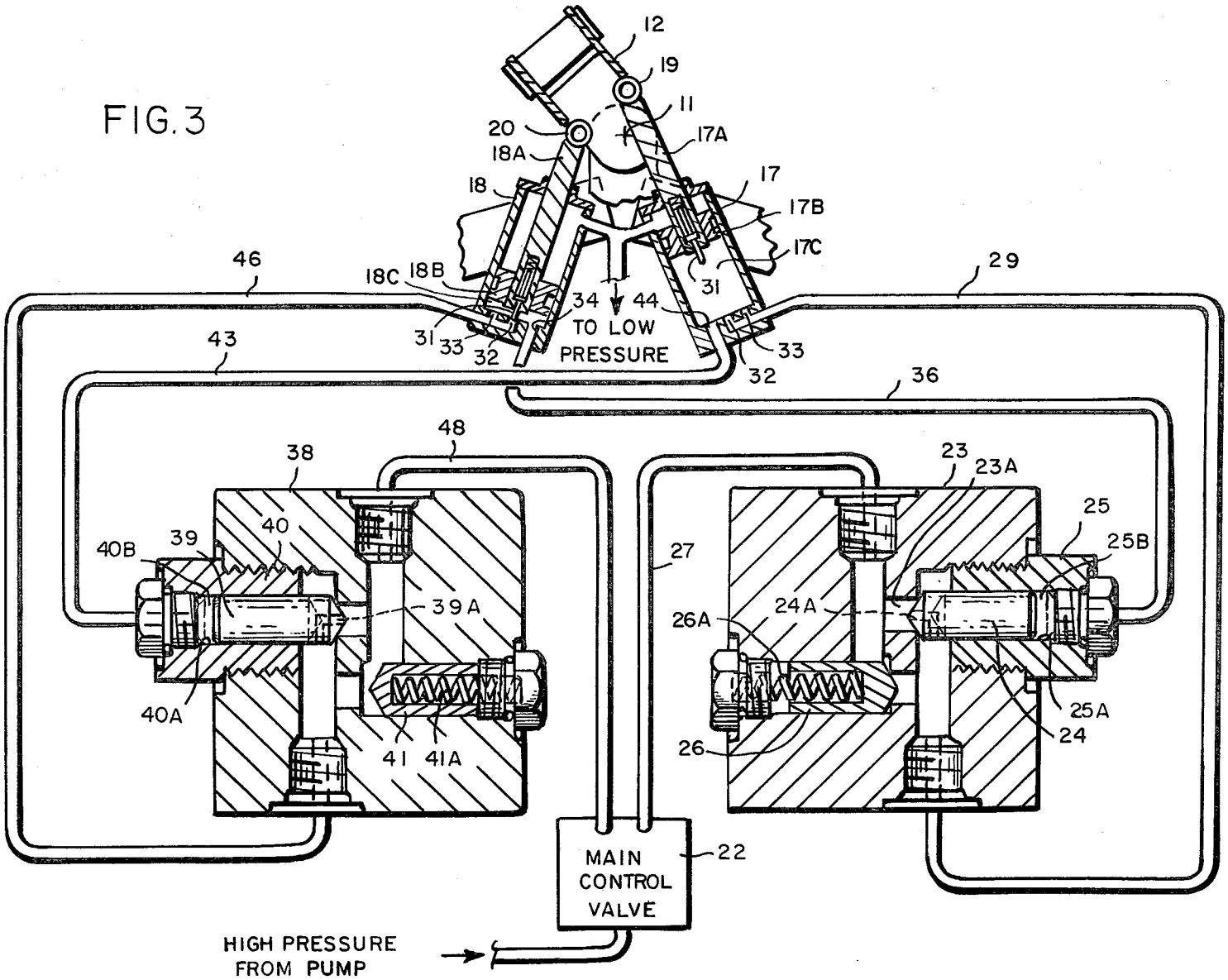
FIG. 3 is a schematic view showing a fluid actuated apparatus embodying the invention with its first restricting piston means shown in full lines wherein it is in seated position to restrict the flow of fluid to the piston side of the first fluid operated cylinder means and in dot dash lines wherein it permits the flow of fluid substantially unrestricted to the piston end of the first cylinder means.

The turret 12 is adapted to be moved pivotally about the vertical axis formed by the pivots 11 by means of the first and second fluid actuated cylinder means 17 and 18 (FIG. 3) which have rod means 17A and 18A attached to their piston means 17B and 18B respectively. As shown in FIG. 3 the rods 17A and 18A are pivotally connected to the turret at 19 and 20 so that pivotal movements of the turret and boom about the pivots 11 are caused when the rods are alternately moved outwardly with respect to the cylinders 17 and 18 respectively.

The fluid system includes a customary first source of fluid under pressure which leads through a conduit from a pump (not shown) to the customary main control valve 22. The main control valve selectively controls the flow of fluid under pressure from the pump through conduits 27 and 48 respectively directly to the first and second fluid restricting valve means 23 and 38 respectively, then passing through the conduits 29 and 46 directly to the first and second fluid actuated cylinder means 17 and 18 respectively. The first restricting valve means 23 comprises a first fluid restricting piston means 24 which is substantially circular in cross section and is slidable longitudinally of the passage 25A in the screw threaded plug 25. The piston means 24 is shown in closed position by the full lines in FIG. 3 and in that position a first chamber 25B is formed near its right hand end.

The first fluid restricting piston means also comprises a fluid restricting orifice 24A the function of which will be explained below.

The first restricting valve means 23 also comprises check valve means 26 which is normally urged to closed position by the coiled compressed spring 26A.

First fluid conduit means 27 provides communication directly between the main control valve and solely one end of the first fluid restricting piston means 24 as shown in FIG. 3. When the check valve 26 is closed, as shown in FIG. 3, the high pressure fluid entering the first restricting valve means 23 from the conduit 27 acting against one end of the first restricting piston means 24 achieves sufficient magnitude to overcome the forces of the pressurized fluid in the first chamber 25B, exerted against the other end of the first fluid restricting piston 24, and causes it to move from its closed position to an at least partially open position and the pressurized fluid passes by said one end of the first fluid restricting piston means downwardly into the second conduit means 29 and thence to the piston end of the first cylinder means 17. This causes the piston 17B to move outwardly in the cylinder means and the rod 17A rotates the turret in a counterclockwise direction to the position shown in FIG. 3.

Such movement of the turret causes the rod 18A and piston 18B of the second cylinder means to be moved by the turret towards their substantially retracted positions shown in FIG. 3.

Figure 4:
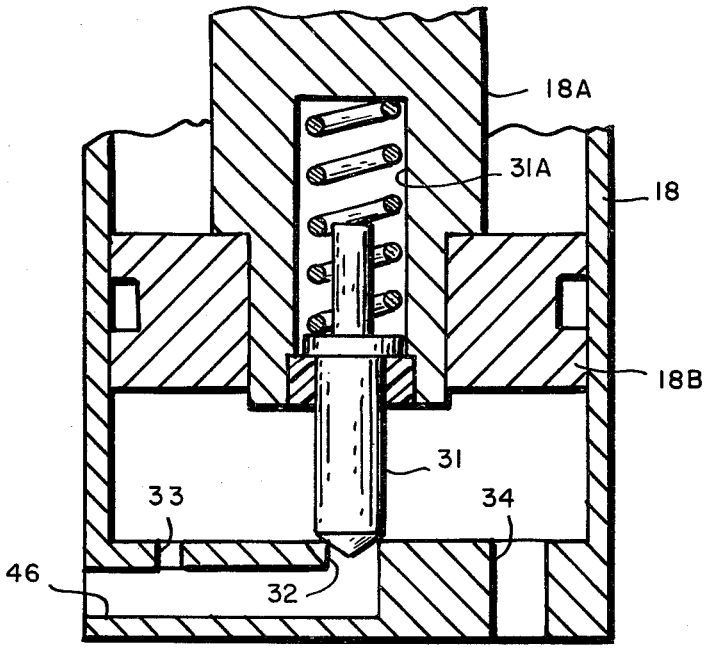
FIG. 4 is an enlarged fragmentary section of the lower part of the second fluid actuated cylinder means of the invention with the parts shown in their positions when the piston of the second cylinder means is approaching the end of its retracting movement.

Referring to FIG. 4, the spring loaded plunger means 31 is mounted in a passage 31A in the piston end of the piston rod means 18A. The piston end of the second cylinder means 18 is preferably provided with three ports. The first port 32 is closeable by the plunger means 31 when the piston of the second cylinder means approaches the end of its retracting movement. The second port 33 is of a reduced size whereby when the first port 32 is closed by the plunger means, throughout all further retracting movement of piston 18B, fluid exhausting from chamber 18C passes through the second port 33.

Fluid passing through the second port 33 (FIG. 3) when the first port is closed reduces the linear velocity of the rod means 18A thereby reducing the velocity of rotation of the turret 12 as the piston 18B approaches the end of its stroke.

From the third port 34 a third conduit means 36 provides communication between the piston end of the second cylinder means 18 and the chamber 25B which is adjacent to the other end of the restricting piston means 24. When the first port 32 is closed by the end of the plunger means 31, pressurized fluid in the conduit 36 entering the chamber 25B moves the piston means 24 towards its closed position.

When the piston means 24 is seated and/or the said first end of said first piston means 24 has closed the said first port 23A of the first restricting valve means, and piston 18B is retracting, the flow of pressurized fluid from said first source of fluid under pressure is restricted at said first port by the said first end of said first piston means, so the flow of fluid through the second conduit 29 to the piston end of the first cylinder means 17 is reduced, thereby reducing the linear velocity of the rod 17A of the first cylinder means. It is to be noted that this reduction of the linear velocity of the rod 17A is caused by moving the first fluid restricting piston means to closed position whereby the said first end of said first piston means 24 has closed said first port 23A of said first fluid restricting valve means, occurs substantially simultaneously with the closing of port 32 causing fluid exhausting from chamber 18C to pass through the restricting port or passage 33 of the second cylinder means 18 which reduces the linear velocity of the rod 18A of the second cylinder means as its piston 18B approaches the end of its stroke. Consequently, the linear velocities of both of the rods 18A and 17A are reduced substantially simultaneously.

When the port 32 is closed and the piston 18B is retracting, thereby causing the pressure of the fluid in the chamber 25B to achieve sufficient magnitude to overcome the forces of the pressurized fluid from the first source of fluid exerted against the said first end of the first fluid restricting piston 24, the pressurized fluid in the chamber 18C causes movement of the first fluid restricting piston means 24 to closed position as shown in full lines in FIG. 3. Then the pressurized fluid from said first source of fluid under pressure passing through conduit 27 is caused to pass through the restricting orifice 24A in the first restricting piston means 24 en route through the conduit 29 to the piston end of the first cylinder means 17. This reduces the linear velocity of the rod 17A of the first cylinder means and the reduction of the linear velocity of that rod occurs substantially simultaneously with the reduction of the linear velocity of the rod 18A of the cylinder 18 caused by closing of port 32 by plunger 31, thereby causing fluid exhausting from chamber 18C of said second cylinder to pass through port or passage 33.

It will be observed that the port 34 is constantly open so that fluid may pass unrestricted through the third conduit means 36 at all times in either direction to or from the first chamber 25B.

The apparatus also comprises a second restricting valve means 38 including a second fluid restricting piston means 39 and they are of the same constructions as the first restricting valve means 23 and first fluid restricting piston means 24. The piston means 39 has a restricting orifice 39A. The piston means 39 is slideable longitudinally in the passage 40A in the screw threaded plug 40. A second chamber 40B is formed near the lefthand end of the piston 39 when it is in its closed position of FIG. 3

Check valve means 41 is normally urged to closed position by a coiled compression spring means 41A.

The fourth conduit means 43 extends from the port 44 in the piston end of the first cylinder means 17 to the chamber 40B. The port 44 and the conduit means 43 function in the same way as the port 34 and conduit 36 to normally urge the second restricting piston means 39 to its seated position when the piston 17B of the cylinder 17 approaches the end of its retracting movement.

The fifth conduit means 46 provides communication between the first and second ports 32 and 33 of the piston end of the second cylinder means 18 and one end of the check valve means 41 as the piston 18B retracts, fluid exhausting through first and second ports 32 and 33 passes through the fifth conduit 46 to said one end of the said check valve 41, and as the second restricting piston 39 is seated, said fluid passes through the conduit 46 and opens the check valve 41 as shown in FIG. 3. Then the exhausting fluid passes through the conduit 48 to the main control valve.

It will be noted that in the embodiment shown in the drawings the fluid restricting piston means 24 and 39 are free from coaction with spring means, cam means, follower means or the like and that consequently the apparatus is both more economical to manufacture and to maintain.

It will be obvious to persons skilled in the art that when the main control valve 22 is actuated to direct the flow of fluid from the pump to the conduit 48 instead of the conduit 27, the second restricting valve means 38, second fluid restricting piston means 39, check valve means 41, conduit 46 and conduit 43 function in the same manner as the first restricting fluid valve means 23 and its associated elements except that the fluid conducted from the conduit 46 causes the piston 18B and its rod 18A to move from retracted to extended positions thereby causing the turret 12 to be moved in a clockwise direction looking at FIG. 3.

The term "fluid" as used in the specification and claims includes both liquids, such as oil or the like, and gases such as air or the like.

It will be apparent to persons skilled in the art that an apparatus embodying this invention has met the long-felt need and has satisfied the above described objects.

While one desirable embodiment of apparatus embodying the invention has been shown in the drawings, it is to be understood that this disclosure is for the purpose of illustration only, and that various changes in shape, proportion and arrangement of parts as well as the substitution of equivalent elements for those shown and described herein may be made without departing from the spirit and scope of the invention as set forth in the appended claims.

I claim:

1. Apparatus of the character described comprising a member mounted for pivotal movement, a source of fluid under pressure, a first fluid actuated cylinder means including a a piston means and a rod means connected to said member, said rod means being movable to rotate said member in one direction, a second fluid actuated cylinder means including a piston means and a rod means connected to said member and movable when said member is rotated in said one direction by said rod means of said first fluid actuated cylinder means, a main control valve for selectively controlling the flow of fluid under pressure from said source of fluid to said first and second fluid actuated cylinder means, a first restricting valve means comprising a first fluid restricting piston means operative solely by fluid under pressure, first fluid conduit means for providing communication directly between said main control valve means and solely one end of said first fluid restricting piston means, for causing movement of said first fluid restricting piston means from its closed position to its open position, second fluid conduit means for providing communication between said first fluid restricting valve means and the piston end portion of said first cylinder means, first fluid restricting orifice means for providing communication between said first fluid conduit means and said second fluid conduit means when said first fluid restricting piston means is in closed position, a plunger means associated with the piston means of said second cylinder means, a first port in the piston end of said second cylinder means which is closable by said plunger means as the piston of said second cylinder means approaches the end of its retracting movement, a reduced size second port in the piston end of said second cylinder means, a third port in the piston end portion of said second fluid actuated cylinder means, third fluid conduit means for providing communication for fluid to pass from the piston end portion of the second cylinder means thru said third port directly and solely to the other end of said first fluid restricting piston means for causing movement of said first fluid restricting piston means to closed position when the piston means of said second cylinder means approaches the end of its retracting movement, whereby throughout the complete outward power movement of the piston of said first fluid actuated cylinder means said one end of said first fluid restricting piston means is responsive to and slidably movable by pressurized fluid from said source of fluid under pressure through said first conduit means and the other end of said first fluid restricting piston means is responsive to pressurized fluid from said second second cylinder means through said third conduit, whereby throughout the complete outward power movement of the piston of said first fluid actuated cylinder means said first fluid restricting piston means is simultaneously responsive to and slidably movable by pressurized fluid and whereby the flow of fluid from said source of fluid under pressure en route from said first conduit means to said second conduit means and thence to the piston end of said first cylinder means is restricted by said first restricting piston means, thereby reducing the linear velocity of the rod of said first cylinder means, a second restricting valve means comprising a second fluid restricting piston means operated solely by fluid under pressure, sixth fluid conduit means for providing communication directly between said main control valve means and solely one end of said second fluid restricting piston means for causing movement of said second fluid restricting piston means from its closed position to its open position, fifth fluid conduit means for providing communication between said second fluid restricting valve means and the piston end portion of said second cylinder means, second fluid restricting orifice means for providing communication between said sixth fluid conduit means and said fifth fluid conduit means when said second fluid restricting piston means is in closed position, a plunger means associated with the piston means of said first cylinder means, a fourth port in the piston end of said first cylinder means which is closable by said plunger means as the piston of said first cylinder means approaches the end of its retracting movement, a reduced size fifth port in the piston end of said second cylinder means, a sixth port in the piston end portion of said first fluid actuated cylinder means, and fourth fluid conduit means for providing communication for fluid to pass from the piston end portion of the first cylinder means thru said sixth port directly and solely to the other end of said second fluid restricting piston means for causing movement of said second fluid restricting piston means to closed position when the piston means of said first cylinder means approaches the end of its retracting movement, whereby throughout the complete outward power movement of the piston of said second fluid actuated cylinder means said one end of said second fluid restricting piston means is responsive to and slidably movable by pressurized fluid from said source of fluid under pressure through said sixth conduit means and the other end of said first fluid restricting piston means is responsive to pressurized fluid from said first cylinder means through said fourth conduit means, whereby throughout the complete outward power movement of the piston of said second fluid actuated cylinder means said second fluid restricting piston means is simultaneously responsive to and slidably movable by pressurized fluid whereby the flow of fluid from said source of fluid under pressure en route from said sixth conduit means to said fifth conduit means and thence to the piston end of said second cylinder means is restricted by said second fluid restricting piston means, thereby reducing the linear velocity of the rod of said second cylinder means.

2. Apparatus according to claim 1 wherein said third port in the piston end of said second cylinder means is constantly open and communicating with said third conduit means, whereby fluid may pass through said third conduit means in either direction to and from the chamber which is adjacent to the other end of the first restricting piston means at all time.

3. Apparatus according to claim 1 wherein when the first port in the second cylinder is closed, throughout all further retracting movement of the piston of the second cylinder, fluid exhausting from the second cylinder passing through the said reduced size second port is restricted, whereby when said first port in the piston end of the said second cylinder is closed, thereby pressurizing the fluid in said third conduit and causing movement of the said first fluid restricting piston to closed position, thereby restricting the flow of fluid passing from the first fluid restricting valve through said second conduit to said first fluid actuated cylinder means, whereby the flow of fluid passing from the first fluid restricting valve through the second fluid conduit means to the first fluid actuated cylinder means and the flow of fluid exhausting from the second fluid actuated cylinder means are restricted substantially simultaneously.

4. Apparatus according to claim 1 wherein the distance between said third port in the piston end portion of the second cylinder means and the outer end of the rod end portion of the second cylinder means is substantially greater than the distance between said third port and the outer end of the piston end of the second cylinder means and the distance between said sixth port in the piston end portion of the first fluid actuated cylinder means and the outer end of the rod end portion of the second cylinder means is substantially greater than the distance between said sixth port and the outer end of the piston end portion of the first cylinder means.

* * * * *

UNITED STATES PATENT OFFICE

CERTIFICATE OF CORRECTION

PATENT NO. : 4,138,928

DATED : Feb. 13, 1979

INVENTOR(S) : John S. Pilch

It is certified that error appears in the above-identified patent and that said Letters Patent are hereby corrected as shown below:

Column 5, line 45, the word "compressed" should be -- compression --;

Signed and Sealed this

*Fourteenth* Day of *August 1979*

[SEAL]

*Attest:*

*Attesting Officer*

LUTRELLE F. PARKER

*Acting Commissioner of Patents and Trademarks*